United States Patent [19]

Kenney

[11] Patent Number: 4,854,277

[45] Date of Patent: Aug. 8, 1989

[54] APPARATUS AND METHOD FOR FLUSHING THE CRANKCASE OF AN INTERNAL COMBUSTION ENGINE

[76] Inventor: Robert D. Kenney, 519 W. Highland Ave., Marion, Ind. 46952

[21] Appl. No.: 218,142

[22] Filed: Jul. 13, 1988

[51] Int. Cl.[4] ..... F01M 1/00

[52] U.S. Cl. ..... 123/196 A; 210/238; 184/1.5

[58] Field of Search ..... 123/196 A, 196 R; 184/1.5; 134/10, 166–169; 210/232, 248

[56] References Cited

U.S. PATENT DOCUMENTS

| | | | |
|---|---|---|---|
| 1,509,327 | 9/1924 | Winchester | 184/1.5 |
| 1,584,505 | 5/1926 | Bevins | 184/1.5 |
| 1,696,100 | 12/1928 | Osborne | 184/1.5 |
| 3,431,145 | 3/1969 | Riley | 134/22 |
| 3,489,245 | 1/1970 | Broadwell | 184/1.5 |
| 4,174,231 | 11/1979 | Hobgood | 134/10 |
| 4,197,140 | 4/1980 | Swan | 134/20 |
| 4,361,207 | 11/1982 | Sylvestre et al. | 184/1.5 |
| 4,507,199 | 3/1985 | Carlisle | 210/248 |

*Primary Examiner*—E. Rollins Cross

*Attorney, Agent, or Firm*—David L. Ahlersmeyer

[57] ABSTRACT

A liquid flow blocking device for use during flushing of the crankcase of an internal combustion engine is disclosed including a plastic disk-shaped member having a central aperture through which the threaded pipe portion of a spin-on oil filter mounting assembly is received, after which a filter is mounted to retain the disk-shaped member adjacent the mounting assembly. Alternatively, a semi-spherical blocking device threadedly mounts to the mounting assembly, replacing the filter. Each device blocks external flow of liquid between oil outflow and inflow passages of the mounting assembly, therby causing flow of liquid through an internal filter bypass valve within the filter mounting assembly. A method of flushing an engine crankcase is disclosed using such a blocking device.

20 Claims, 1 Drawing Sheet

APPARATUS AND METHOD FOR FLUSHING THE CRANKCASE OF AN INTERNAL COMBUSTION ENGINE

BACKGROUND OF THE INVENTION

The present invention relates generally to methods and apparatuses for cleaning the crankcase of an internal combustion engine by means of flushing the crankcase to remove dirt and sediment therefrom, and more particularly to an apparatus and method for cleaning an engine of the type having an oil filter mounting assembly wherein an internal bypass valve permits circulating oil to bypass the mounted oil filter.

It is the general practice in maintaining a four-cycle internal combustion engine to change the oil and filter periodically by draining the crankcase, replacing the oil filter, and refilling the crankcase with clean oil. However, this practice does not remove all the sludge and contaminants that build up in an engine crankcase over time, thereby adversely affecting engine operating efficiency and decreasing engine life. Accordingly, the preferred method of cleaning an internal combustion engine is to perform a crankcase flushing operation, which cleans engine components and removes sludge and contaminants from the crankcase.

Known apparatuses and methods for flushing engines either require expensive equipment and complicated procedures, or do not achieve satisfactory results. For instance, one known method of flushing an engine crankcase involves replacing the oil in the crankcase with a suitable flushing liquid while keeping the dirty oil filter for use during the flushing operation. One problem with this method is that the flushing liquid passes through the dirty filter and carries contaminants throughout the engine where they may remain after completion of the flushing operation. Furthermore, the oil filter, already dirty, may become clogged further and prevent easy passage of the flushing liquid therethrough.

Another known method of flushing engines is directed to overcoming the disadvantages associated with using a dirty filter during flushing and involves replacing the dirty filter with a clean filter for the purpose of flushing the engine. After the flushing operation is completed, the clean filter is dirty and must be replaced before adding the new oil. Therefore, this method requires the use of two new filters, as well as the mess and inconvenience of having to remove two dirty filters.

A further apparatus and method for flushing an internal combustion engine is shown and described in U.S. Pat. No. 4,174,231, issued to H. Hobgood. This patent discloses the use of a hollow adaptor device which replaces an oil filter and allows the flushing fluid to flow therethrough unfiltered. One disadvantage of this device and method is the mess and inconvenience associated with having to dispense of the cleaning liquid trapped in the hollow device. Furthermore, the adaptor is structurally similar to an ordinary oil filter and, as such, would be equally expensive.

The present invention is directed to overcoming the problems and disadvantages of the above-described prior art methods and apparatuses for cleaning internal combustion engines by flushing.

SUMMARY OF THE INVENTION

The present invention overcomes the aforementioned problems and disadvantages of the prior art methods and apparatuses for cleaning internal combustion engines by providing an improved method and apparatus for flushing the engine crankcase wherein cleaning fluid is blocked from flowing externally of the engine and is made to circulate through a bypass valve within the oil filter mounting assembly.

Generally, the present invention provides an apparatus and method for flushing the crankcase of an engine of the type wherein an oil filter mounting assembly includes an outflow passage, an inflow passage, and an internal bypass valve to permit internal communication therebetween in the event the mounted oil filter becomes clogged and oil flow therethrough is restricted. A liquid flow blocking device is utilized in a method of flushing an engine crankcase to intentional block flow of flushing liquid externally of the filter mounting assembly and necessitate liquid flow through the bypass valve.

More specifically, the liquid flow blocking device of the present invention, in one form thereof, comprises a disk-shaped member that is placed intermediate an oil filter and the oil filter mounting assembly to block liquid from flowing externally of the mounting assembly and through the filter. Instead, the liquid flows within the mounting assembly through the bypass valve. In another form of the invention, a blocking device threadedly mounts directly on the oil filter mounting assembly, so as to replace the oil filter during the flushing operation. In both forms of the invention, circulation of oil is confined within the engine.

An advantage of the engine crankcase flushing method and apparatus of the present invention is that the required hardware is inexpensive and easy to manufacture.

Another advantage of the engine crankcase flushing method and apparatus of the present invention is that it is simple and clean to use for the purpose of flushing an engine crankcase.

A further advantage of the engine crankcase flushing method and apparatus of the present invention is that liquid flow is confined within the engine, thereby avoiding the need for greater volumes of liquid for external liquid storage chambers and the mess associated with disposing thereof.

Yet another advantage of the engine crankcase flushing method and apparatus of the present invention is that more thorough engine crankcase cleaning is achieved with greater ease and less expense.

The present invention provides, in one form thereof, an apparatus for use during flushing of an engine crankcase, wherein the engine is an internal combustion engine of the type having a spin-on oil filter mounting assembly. The mounting assembly includes an outflow passage, an inflow passage, a threaded pipe portion on which a spin-on oil filter can be removably mounted, and an internal pressure bypass valve between the outflow passage and the inflow passage to permit internal oil flow therebetween when oil flow through a mounted oil filter becomes restricted. The apparatus attaches to the mounting assembly and comprises a liquid flow block for intentionally blocking flow of liquid between the outflow passage and the inflow passage, thereby causing liquid to flow between the outflow passage and the inflow passage through the internal pressure bypass valve. In one form of the invention, the liquid flow block comprises a disk-shaped member having a central aperture therethrough, wherein the pipe portion is threadedly received through the aperture. In this form of the invention, the disk-shaped member is of a plastic material sufficiently soft to permit self-threading engagement of the aperture about the threaded pipe portion. In another form of the invention, the liquid flow block comprises a threaded cap member operably mounted to the oil filter mounting assembly such that both the outflow passage and the inflow passage are covered.

The present invention further provides, in one form thereof, a method of flushing a crankcase of an engine with flushing liquid, wherein the engine is an internal combustion engine of the type having a spin-on oil filter mounting assembly. The filter mounting assembly includes an outflow passage, an inflow passage, a threaded pipe portion on which a spin-on oil filter can be removably mounted, and an internal pressure bypass valve between the outflow passage and the inflow passage. The bypass valve permits internal oil flow between the outflow and inflow passages when oil flow through a mounted oil filter becomes restricted. The steps of the method include draining the engine crankcase of any fluids contained therein, and removing the used spin-on oil filter from the mounting assembly. Flushing liquid is then placed in the engine crankcase, and the engine is operated to effect circulation of the flushing liquid in the engine to cause flow of the flushing liquid between the outflow passage and the inflow passage through the bypass valve. Accordingly, the flushing liquid flows externally of the oil filter mounting assembly. The flushing liquid is caused to flow through the bypass valve due to the provision of a liquid flow blocking member attached to the mounting assembly. The liquid flow blocking member intentionally blocks the flow of liquid between the outflow passage and the inflow passage, thereby causing the liquid to flow between the outflow passage and the inflow passage through the internal pressure bypass valve.

DETAILED DESCRIPTION OF THE PREFERRED EMBODIMENT

Figure 1:
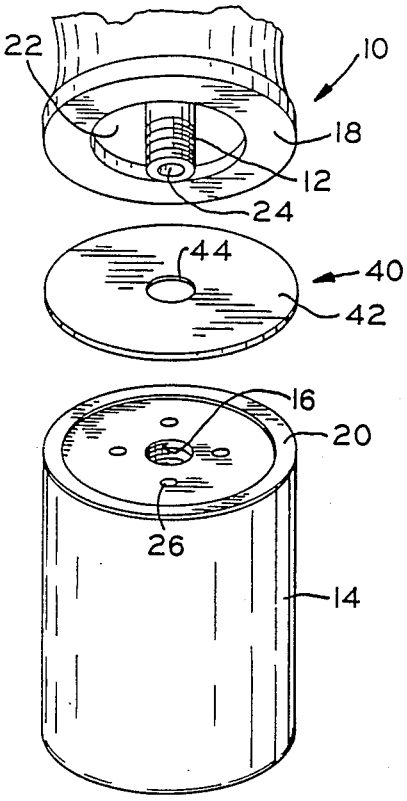
FIG. 1 is an exploded fragmentary perspective view showing a disk-shaped member, in accordance with one embodiment of the present invention.
Figure 2:
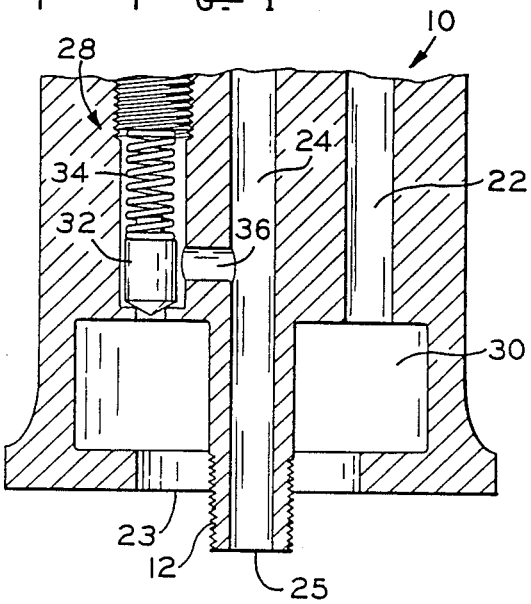
FIG. 2 is an enlarged fragmentary sectional view of the spin-on oil filter mounting assembly of FIG. 1, the mounting assembly being of the type to which the present invention pertains, particularly showing a bypass valve within the assembly.

Referring now to the drawings, and particularly to FIGS. 1 and 2, there is shown a spin-on oil filter mounting assembly 10 of the type to which the present invention pertains. More specifically, assembly 10 includes a threaded pipe portion 12 on which a spin-on oil filter 14 is removably mounted by means of a threaded opening 16 therein. Assembly 10 also includes a radially outer annular mounting flange 18 against which an annular sealing gasket 20 of oil filter 14 sealingly contacts when the filter is screwed onto the mounting assembly.

Oil filter mounting assembly 10 further includes an annular outflow passage 22 circumjacent threaded pipe portion 12, and an inflow passage 24 extending axially through pipe portion 12. In the usual manner of operation of the oil filter mounting assembly in the absence of the present invention, oil pumped by the engine exits outflow passage 22 and enters oil filter 14 through a plurality of inlet openings 26. After flowing radially inwardly through a filtering element (not shown), the oil flows out of oil filter 14 through an outlet opening comprising threaded opening 16 and returns to the engine crankcase through inflow passage 24.

Referring now to FIG. 2, there is shown an oil filter mounting assembly of the type to which the present invention pertains, wherein a pressure actuated bypass valve 28 permits flow of liquid between outflow passage 22 and inflow passage 24 internally of mounting assembly 10. Valve 28 operates whenever flow between the two passages externally of the mounting assembly is restricted to the point at which oil pressure within a chamber 30 is sufficient to actuate valve seat 32 against the biasing force of valve spring 34. Once valve seat 32 is lifted, chamber 30 is in fluid communication with inflow passage 24 through a connecting passage 36, whereby the flow of oil bypasses the oil filter and flows from outflow passage 22 to inflow passage 24 via chamber 30 and connecting passage 36.

As shown in FIG. 2, outflow passage 22 communicates with the outside of mounting assembly 10 through an annular outflow opening 23 circumjacent pipe portion 12. Likewise, inflow passage 24 communicates through inflow opening 25 located on the end of pipe portion 12. When oil filter 14 is operably mounted to mounting assembly 10, outflow opening 23 communicates with inlet openings 26 and inflow opening 25 communicates with threaded opening 16.

The present invention resides primarily in the recognition that bypass valve assembly 28 may be used in conjunction with a liquid flow blocking device 40 during flushing of an engine crankcase to yield significant advantages over prior art methods and apparatuses. Liquid flow blocking device 40 will now be described with respect to two embodiments in accordance with the present invention.

Figure 3:
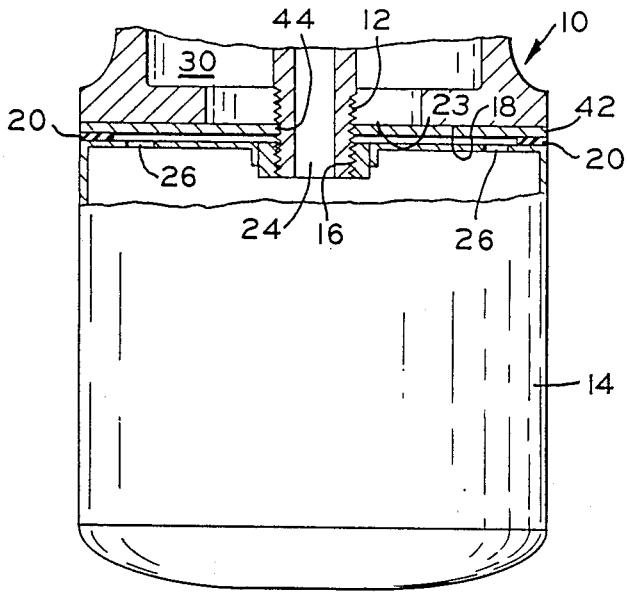
FIG. 3 is an enlarged fragmentary sectional view showing the components of FIG. 1 assembled, wherein a disk-shaped member intermediate the mounting assembly and a mounted filter acts as a liquid flow blocking device.

FIGS. 1 and 3 illustrate a first embodiment of the present invention wherein blocking device 40 comprises a disk-shaped member 42 having an aperture 44 extending therethrough at a central location thereof. Disk-shaped member 42 is preferably made of a heat resistant plastic material to withstand engine operating temperatures. The plastic material should be sufficiently soft to allow self-threading of aperture 44 onto threaded pipe portion 12 as shown in FIG. 3. Specifically, aperture 44 is sized approximately equal to the inside thread diameter of pipe portion 12, and is smooth until threaded thereon. Member 42 is preferably of a thickness of approximately 1/16–⅛ inches. Also, the diameter of disk-shaped member 42 is such that member 42 extends radially outwardly adjacent annular mounting 18 when operably mounted as shown in FIG. 3. The diameter of member 42 may vary according to the particular engine and oil filter mounting assembly, but typically would be in the range of 3 to 4 inches.

Referring once again to FIG. 3, disk-shaped member 42 is sealingly threaded onto pipe portion 12 far enough so that a radially outer portion thereof contacts annular mounting 18. Oil filter 14 is then screwed onto pipe portion 12, whereby sealing gasket 20 forces the radially outer portion of disk-shaped member 42 against annular mounting 18. Accordingly, member 42 seals about pipe portion 12 and against annular mounting 18, whereby outflow opening 23 is sealingly covered, thereby causing liquid flowing from outflow passage 22 to actuate bypass valve assembly 28 and enter inflow passage 24 without flowing externally of mounting assembly 10.

It will be appreciated from the description of disk-shaped member 42 that, while a filter is necessary to positively retain member 42 against mounting 18, the filter used may be the new replacement one, whereby the flushing operation is cleaner and more easily conducted. Specifically, it is contemplated that the original dirty filter would be removed, after which disk-shaped member 42 would be installed together with a new oil filter 14. After the flushing operation, the new oil filter 14 would be removed, member 42 would be removed, and then the new oil filter 14 would be replaced. This presents a significant advantage over the prior art wherein dirty oil filters or hollow adapters filled with liquid need to be disposed of.

Figure 4:
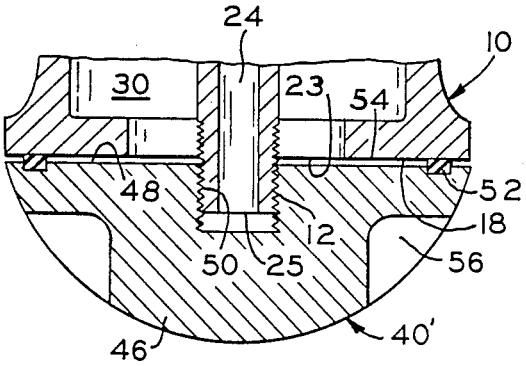
FIG. 4 is a fragmentary sectional view of a liquid flow blocking device in accordance with an alternative embodiment of the present invention, shown mounted to the oil filter mounting assembly of FIG. 1.
Figure 5:
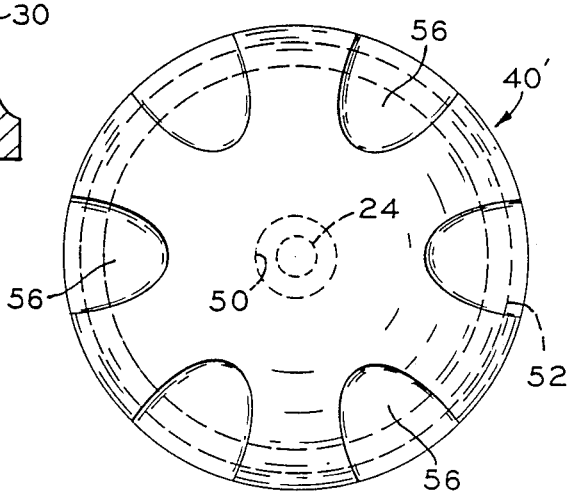
FIG. 5 is a bottom view of the liquid flow blocking device of FIG. 4, particularly showing gripping recesses therein.

Referring now to FIGS. 4 and 5 for an alternative embodiment of the apparatus of the present invention, there is shown a liquid flow blocking device 40′ comprising a semi-spherical body 46 made of plastic, wood, or any other suitable material. Body 46 includes a generally planar surface 48 having a threaded bore 50 located at the approximate center thereof. When mounted to mounting assembly 10, threaded pipe portion 12 is received within threaded bore 50, whereby inflow opening 25 is completely closed off. An annular seal element 52, similar to that on an ordinary spin-on filter, is attached to body 46 at a radially outer portion of surface 48. Accordingly, when body 46 is mounted onto mounting assembly 10, an annular region 54 defined radially intermediate pipe portion 12 and annular seal 52 essentially overs outflow opening 23, thereby causing bypass valve assembly 28 to carry the flow of liquid between outflow passage 22 and inflow passage 24, as previously described.

For operator ease in gripping semi-spherical body 46 during mounting thereof to mounting assembly 10, FIGS. 4 and 5 show the semi-cylindrical surface of body 46 as having a plurality of recesses 56 easily gripped by the fingers of the operator.

It will be appreciated that while disk-shaped member 42 of the embodiment of FIGS. 1 and 3 has been described as being made entirely of plastic, a disk-shaped member made of sheet metal or the like having a radially inner plastic insert for forming aperture 44 may also be used, whereby the plastic insert permits aperture 44 to self thread onto pipe portion 12. Also, while disk-shaped member 42 has been described as being capable of sealing against annular mounting 18 with the aid of back pressure provided by oil filter 14, an annular bead of rubberized gasket-type material may be provided along the peripheral edge thereof to help seal between member 42 and annular mounting 18.

The disclosed method of flushing an engine crankcase, in accordance with the principles of the present invention, involves initially removing the dirty oil filter 14 from mounting assembly 10 and placing a liquid flow blocking device 40, in accordance with one of the two embodiments disclosed herein, onto mounting assembly 10. In the case of disk-shaped member 42, a new oil filter 14 may be used to secure member 42 operably in place during the flushing operation. As part of the flushing operation, the crankcase is drained of the dirty oil and is filled with flushing liquid. The engine is then operated for several minutes during which the flushing liquid flows through bypass valve assembly 28, as previously described. Accordingly, the internal engine components are thoroughly cleaned with the flushing liquid flowing entirely within the engine crankcase and oil filter mounting assembly 10, i.e. between outflow passage 22 and inflow passage 24 through bypass valve assembly 28.

Upon completion of the flushing operation, the engine is stopped and the liquid flow blocking device 40 is removed. A new oil filter 14 is mounted to oil filter mounting assembly 10 and new oil is placed in the crankcase.

It will be appreciated that the foregoing description of a preferred embodiment of the invention is presented by way of illustration only and not by way of any limitation, and that various alternatives and modifications may be made to the illustrated embodiment without departing from the spirit and scope of the invention.

What is claimed is:

1. In an internal combustion engine of the type having a spin-on oil filter mounting assembly including an outflow passage, an inflow passage, a threaded pipe portion on which a spin-on oil filter can be removably mounted, and an internal pressure bypass valve between said outflow passage and said inflow passage to permit internal oil flow therebetween when oil flow through a mounted oil filter becomes restricted, an apparatus for use during flushing of the engine crankcase, comprising;

liquid flow blocking means, attachable to said mounting assembly, for intentionally blocking flow of liquid between said outflow passage and said inflow passage, thereby causing liquid to flow between said outflow passage and said inflow passage through said internal pressure bypass valve.

2. The apparatus of claim 1 in which:

said liquid flow blocking means comprises a disk-shaped member having a central aperture therethrough, said pipe portion being threadedly received through said aperture.

3. The apparatus of claim 2 in which:

said disk-shaped member is capable of being operably retained intermediate said filter mounting assembly and an oil filter mounted thereto.

4. The apparatus of claim 3 in which:

said disk-shaped member blocks liquid that would ordinarily flow out of said oil filter mounting assembly from said outflow passage into a mounted oil filter, and said inflow passage remains in communication with the mounted oil filter, whereby liquid is blocked from flowing into a mounted filter and, consequently, no oil flows therefrom.

5. The apparatus of claim 2 in which:

said disk-shaped member is of a plastic material sufficiently soft to permit self-threading engagement of said aperture about said threaded pipe portion.

6. The apparatus of claim 1 in which:

said liquid flow blocking means comprises a threaded cap member operably mounted to said oil filter mounting assembly such that both said outflow passage and said inflow passage are covered, whereby no liquid flow path external of said oil filter mounting assembly exists therebetween.

7. The apparatus of claim 6 in which:

said cap member comprises a generally semi-cylindrical body having a substantially planar surface in which a threaded bore is formed into which said threaded pipe portion is received.

8. The apparatus of claim 7, wherein said inflow passage extends axially through said pipe portion and includes an inflow opening at an end thereof for communication with a mounted filter, and said outflow passage includes an annular outflow opening circumjacent said pipe portion for communication with a mounted filter, in which:

said threaded bore operably covers said inflow opening and the portion of said planar surface circumjacent said threaded bore operably covers said annular outflow opening, whereby no liquid flow path external of said oil filter mounting assembly exists therebetween.

9. The apparatus of claim 7 in which:

said cap member includes means about the outer periphery thereof for gripping said cap member to aid an operator when installing said cap member onto said oil filter mounting assembly.

10. In an internal combustion engine of the type having a spin-on oil filter mounting assembly including a threaded pipe portion on which a spin-on oil filter can be removably mounted, an outflow passage having an annular outflow opening defined radially intermediate the threaded pipe portion and a radially outer annular mounting flange portion for communication with the inlet of a mounted oil filter, an inflow passage extending axially through the pipe portion and having an inflow opening for communication with the outlet of a mounted oil filter, and an internal pressure bypass valve between said outflow passage and said inflow passage to permit flow of oil therebetween within said oil filter mounting assembly when a mounted oil filter presents an excessively restricted flow path for the oil, an apparatus for use during flushing of the engine crankcase, comprising:

liquid flow blocking means, threadedly engaging said threaded pipe portion and extending radially outwardly to sealingly contact against said mounting flange portion, for intentionally blocking flow of liquid between said outflow opening and said inflow opening externally of said oil filter mounting assembly, thereby causing liquid to flow between said outflow passage and said inflow passage through said internal pressure bypass valve.

11. The apparatus of claim 10 in which:

said liquid flow blocking means comprises a disk-shaped member including a central aperture through which said pipe portion is sealingly threadedly received and a radially outer portion having a diameter sufficiently large to insure contact of said radially outer portion with said mounting flange portion, said disk-shaped member being retained adjacent said oil filter mounting assembly by means of an oil filter mounted thereto, whereby said disk-shaped member sealingly covers said outflow opening.

12. The apparatus of claim 11 in which:

said disk-shaped member is of a plastic material sufficiently soft to permit self-threading engagement of said aperture about said threaded pipe portion.

13. The apparatus of claim 10 in which:

said liquid flow blocking means comprises a generally semi-cylindrical cap member having a substantially planar surface in which a threaded bore is formed into which said threaded pipe portion is sealingly threadedly received, said cap member being operably mounted to said oil filter mounting assembly such that said threaded bore operably covers said inflow opening and a radially outer portion of said planar surface circumjacent said threaded bore operably covers said annular outflow opening, whereby no liquid flow path external of said oil filter mounting assembly exists therebetween.

14. The apparatus of claim 13 in which:

said cap member includes an annular seal element located at said radially outer portion thereof, said seal element extending between said planar surface and said mounting flange portion to seal therebetween.

15. In an internal combustion engine of the type having a spin-on oil filter mounting assembly including an outflow passage, an inflow passage, a threaded pipe portion on which a spin-on oil filter can be removably mounted, and an internal pressure bypass valve between said outflow passage and said inflow passage to permit internal oil flow therebetween when oil flow through a mounted oil filter becomes restricted, a method of flushing the crankcase of the engine with a flushing liquid, comprising the steps of:

draining the engine crankcase of any fluids contained therein;

removing the used spin-on oil filter from said mounting assembly;

placing the flushing liquid in the engine crankcase; and operating the engine to effect circulation of the flushing liquid in the engine to cause flow of the flushing liquid between said outflow passage and said inflow passage through said bypass valve without flowing externally of said oil filter mounting assembly.

16. The method of claim 15 in which:

said step wherein flushing liquid is caused to flow through the bypass valve is performed by providing liquid flow blocking means, attachable to said mounting assembly, for intentionally blocking flow of liquid between said outflow passage and said inflow passage, thereby causing liquid to flow between said outflow passage and said inflow passage through said internal pressure bypass valve.

17. The method of claim 16, and further comprising the steps of:

providing liquid flow blocking means for intentionally blocking flow of liquid between said outflow passage and said inflow passage, said means comprising a disk-shaped member having a central aperture therethrough;

installing said disk-shaped member onto said oil filter mounting assembly; and retaining said disk-shaped member on said oil filter mounting assembly by placing a spin-on oil filter onto said mounting assembly such that said disk-shaped member is operably retained therebetween.

18. The method of claim 17 in which:

said disk-shaped member is retained on said oil filter mounting assembly by the used oil filter.

19. The method of claim 17 in which:

said disk-shaped member is retained on said oil filter mounting assembly by a new filter.

20. The method of claim 17, and further comprising the step of:

providing liquid flow blocking means for intentionally blocking flow of liquid between said outflow passage and said inflow passage, said means comprising a generally semi-cylindrical cap member having a substantially planar surface in which a threaded bore is formed into which said threaded pipe portion is sealingly threadedly received; and installing said disk-shaped member onto said oil filter mounting assembly.

* * * * *